US005697098A

United States Patent [19]

Miguel-Bettencourt et al.

[11] Patent Number: 5,697,098

[45] Date of Patent: Dec. 16, 1997

[54] LAYERED COMPOSITE BODY ARMOR

[75] Inventors: Kenneth C. Miguel-Bettencourt, 224 Bonita La., Foster City, Calif. 94404; Allan D. Bain, San Marcos, Calif.

[73] Assignee: Kenneth C. Miguel-Bettencourt, Foster City, Calif.

[21] Appl. No.: 601,139

[22] Filed: Feb. 13, 1996

[51] Int. Cl.[6] ..... A41D 13/00

[52] U.S. Cl. ..... 2/2.5; 428/911

[58] Field of Search ..... 2/2.5; 428/911

[56] References Cited

U.S. PATENT DOCUMENTS

| | | | |
|---|---|---|---|
| 3,130,414 | 4/1964 | Bailey et al. | 2/2.5 |
| 3,392,406 | 7/1968 | Pernini et al. | 2/2.5 |
| 4,648,136 | 3/1987 | Higuchi | 2/2.5 |
| 4,660,223 | 4/1987 | Fritch | 2/2.5 |
| 4,989,266 | 2/1991 | Borgese et al. | 2/2.5 |
| 5,306,557 | 4/1994 | Madison | 428/304.4 |
| 5,472,769 | 12/1995 | Goerz, Jr. et al. | 428/138 |

FOREIGN PATENT DOCUMENTS

| | | | |
|---|---|---|---|
| 8403529 | 6/1986 | Netherlands | 2/2.5 |
| 2124887 | 2/1984 | United Kingdom | 2/2.5 |
| 2258294 | 4/1989 | United Kingdom | 428/911 |

OTHER PUBLICATIONS

EPO 611943; Aug. 1994; Flexible Shield for Protection Against Penetration, Kantara.

*Primary Examiner*—Bibhu Mohanty
*Attorney, Agent, or Firm*—Thomas Schneck

[57] ABSTRACT

Provided is a seamless soft body armor capable of withstanding penetration from both blunt missiles, e.g. bullets, and cutting implements, e.g. knives, which is relatively light-weight and flexible. To avoid seams, the body armor is formed from a plurality of layers of metallic material, each of which is formed from titanium foil, with a central portion of each layer rigidly attached to a central portion of an adjacent layer of metallic material with adhesive to form a rigid portion disposed between two flexible side regions. The flexible side regions are provided so that the body armor may conform to a shape of a human torso. The metallic layers are sandwiched between a pair of spaced apart fiber layers, with the periphery of the fiber layers attached to each other. The metal layers form two sections of the armor material: the base and the strike face. The outer edge of the base extends beyond the outer edge of the strike surface to reduce weight while affording greater resistance to penetration. The periphery of the fiber terminates approximately 0.5 inch from the outer edge of the base to provide comfort when worn by a user.

22 Claims, 3 Drawing Sheets

LAYERED COMPOSITE BODY ARMOR

TECHNICAL FIELD

The present invention pertains to the field of body armor. Specifically, the present invention pertains to composite body armor which is resistant to puncturing by both sharp objects and blunt missiles.

BACKGROUND ART

Soft body armor is well known in the art. Two major criteria must be entertained in designing body armor. The body armor must be both sufficiently resistant to penetration by weapons and sufficiently flexible to allow a wearer to move freely between different body positions, e.g. sitting and standing. The aforementioned weapons may be generally characterized as one of two weapon types: blunt missiles, e.g. bullets, or cutting implements, e.g. knives, ice pikes and the like. Providing armor with greater resistance to penetration by one weapon type typically compromises either the armor's resistance to the remaining weapon type, the armor's flexibility or both. For example, body armor formed from either aramid or polyethylene fiber is highly resistive to penetration by blunt missiles. Fiber is, however, easily severed by cutting implements, making it unsuitable for protection in many instances. Metal panels may overcome the protection deficiency of fiber material, but are often easily penetrated by blunt missiles, unless made very thick, or are covered with aramid and polyethylene fiber layers. This type of armor is often heavy and inflexible, making it unsuitable for long-term wear. Many prior art attempts have been made to address these issues.

U.S. Pat. No. 5,472,769 to Goerz, Jr. et al. discloses soft body armor material fabricated from tight knitted, light weight, durable fibers, such as aramid fibers. The fabric is arranged in a plurality of layers attached together with stitches or adhesives. Resistance to pointed objects is afforded by the knitted construction, which resists lateral displacement of the individual fibers in response to the application of a pointed object. A deflection shield may be included to provide additional resistance to sharp objects. In one embodiment, the deflection shield may be formed from either a thin mesh of stainless steel or titanium wire. In an alternate embodiment, the deflection shield may be formed from a sheet of light-weight metal, such as titanium.

U.S. Pat. No. 5,306,557 to Madison discloses a hard body armor system consisting of a boron carbide strike surface, aramid fiber layers, polyethylene fiber layers and two metallic foil layers with no adhesive between them. One of the two metallic layers is disposed adjacent to a polyethylene layer, with the polyethylene layer and the two metallic layers disposed between two aramid fiber layers. Adjacent to one of the aramid fiber layers are thirteen layers of boron carbide, with a layer of carbon fiber disposed adjacent to the thirteen layers of boron carbide on the side opposite to the aramid layer. Adjacent to the remaining aramid layer is a second layer of polyethylene fibers, with a layer of foam disposed adjacent thereto on the side opposite to the aramid fibers. Adjacent to the foam layer is a third layer of polyethylene fibers, with a layer of carbon fiber disposed adjacent to the third layer of polyethylene fibers. The armor is constructed so that the metallic foil layers delaminate upon impact of a projectile. The foam layer provides the room necessary for the projectile to expand, while reducing penetration and backface deformation. A drawback with this design is that it is relatively inflexible and heavy.

U.S. Pat. No. 4,989,266 to Borgese et al. discloses soft body armor which includes a plurality of layers of polyethylene fibers sandwiched between a plurality of layers of aramid fibers. The layers of aramid fibers in each set are sewn together along a central portion of each layer. A drawback with this design is that it requires a substantial number of layers of fiber to provide adequate protection from cutting implements. This results in decreased flexibility and increased weight of the body armor.

U.S. Pat. No. 4,660,223 to Fritch discloses soft body armor formed from a plurality of panels, providing front and back body inserts, which are to be worn under regular clothing. Each panel consists of a ply of titanium metal bonded to a ply of aramid fiber woven cloth. The panels are arranged in overlapping and abutting relationship. The panels are joined together vis-a-vis the aramid fiber woven cloth. A drawback with this design is that the titanium metal plies are relatively thick, thereby reducing the flexibility, while increasing the weight of the body armor.

U.S. Pat. No. 4,648,136 to Higuchi discloses soft body armor that includes a front layer and a rear layer. Each layer comprises a plurality of segments having a hexagon shape. The segments are arranged with circumferential edges of adjacent segments contacting each other so that spaces between adjacent segments are substantially eliminated. The joining lines between adjacent segments of one layer are covered by segments of an adjacent layer, forming an overlapping arrangement. In this manner, the interface of adjacent segments in any one layer is reduced by the adjacent layer of segments. However, this design is relatively rigid, which renders it unsuitable for forming to the body of the wearer, leaving large portions of a wearer's side unprotected.

What is needed is a relatively light-weight and flexible soft body armor which is resistant to penetration by both blunt missiles and cutting implements.

SUMMARY OF THE INVENTION

Provided is a seamless soft body armor insert capable of withstanding penetration from both blunt missiles, e.g. bullets, and cutting implements, e.g. knives, which is relatively light weight and flexible. The seamless design is based upon the discovery that microscopic spaces in seams compromise the armor's effectiveness in reducing penetration by various weapons. To avoid seams, the body armor is formed from a plurality of layers of metallic material, each of which is formed from 15-333 Ti alloy foil. A central portion of each layer of metallic material is rigidly attached to a central portion of an adjacent layer of metallic material with adhesive to form a rigid portion disposed between two flexible side regions. The flexible side regions are provided so that the body armor may conform to a shape of a human torso. The metallic layers are sandwiched between a pair of spaced apart fiber layers, with the periphery of the fiber layers attached to each other. The fiber material is described as aramid fibers, such as KEVLAR® or polyethylene fibers, such as SPECTRA SHIELD®. In addition, the fiber layers may be made from TWARON® or P.B.O. liquid crystal polymer.

The metal layers form two sections of the armor material: the base and the strike face. The base comprises a sufficient number of layers of 15-333 Ti alloy foil to provide a thickness ranging from 0.043 to 0.046 inches. The strike face is formed from a sufficient number of layers of 15-333 Ti alloy foil to provide a thickness ranging from 0.008 to 0.012 inches. The outer edges of the base extends about the outer edges of the strike surface, terminating two inches therefrom. The periphery of the fiber layers terminates approximately 0.5 inch from the outer edge of the base.

BEST MODE FOR CARRYING OUT THE INVENTION

Figure 1:
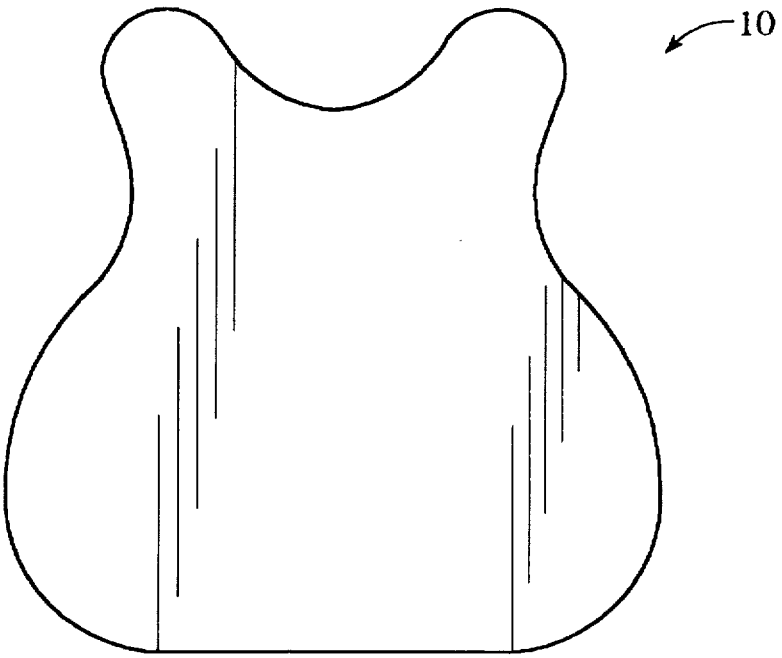
FIG. 1 is a front view of the present invention.
Figure 2:
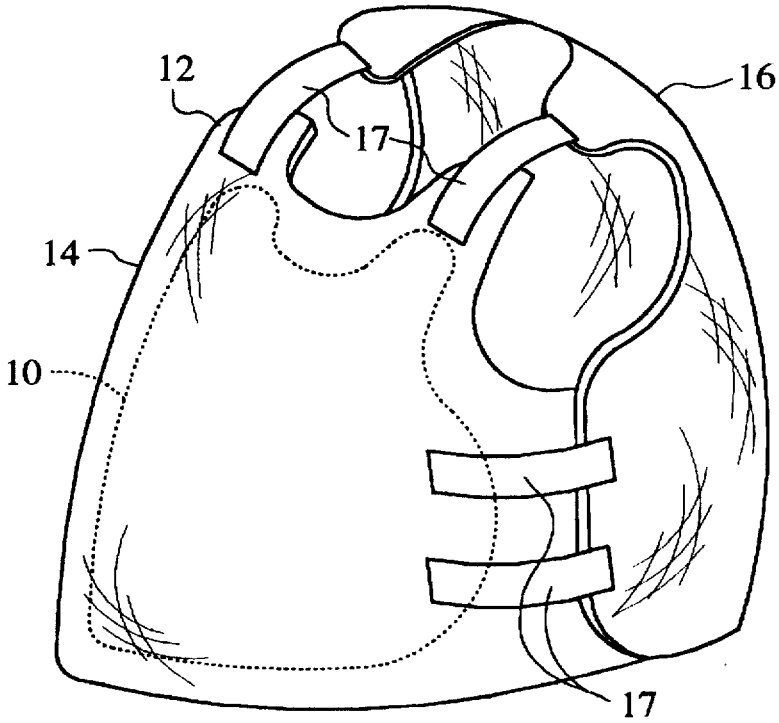
FIG. 2 is a perspective view of the present invention assembled in a harness to be worn by a user.

FIGS. 1 and 2 each shows the body armor as an insert 10 that may be worn with a carrier 12. Carrier 12 may be fabricated from nylon and typically requires two inserts 10, one for a front 14 and one for a back 16, as well as connecting straps 17. However, two inserts 10 may be worn free of the carrier 12 by providing connecting straps at the proper locations to ensure the inserts 10 conform to the torso of a wearer.

Figure 3:
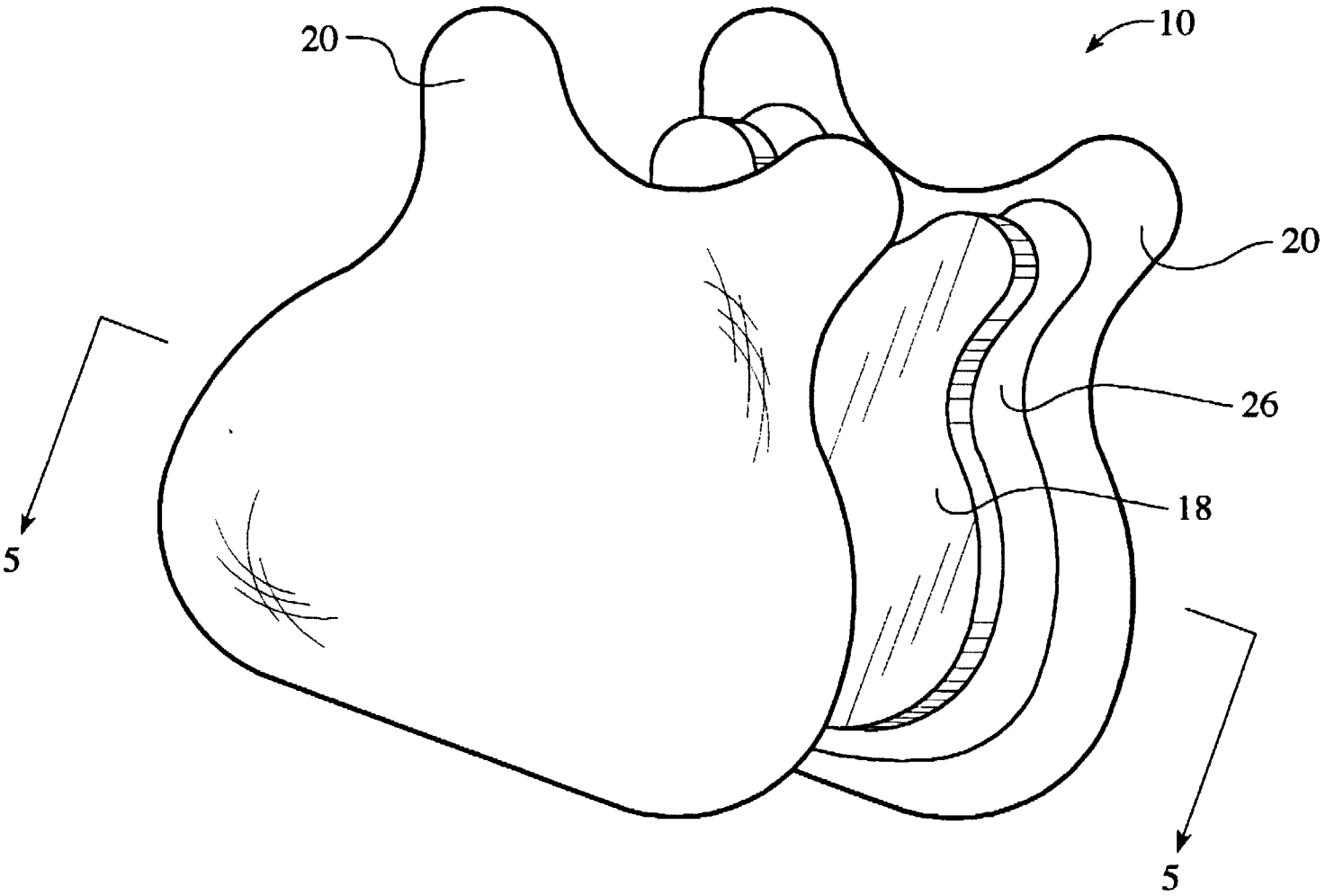
FIG. 3 is a blown-apart perspective view of the invention shown in FIG. 1.

Referring also to FIG. 3, armor insert 10 is shown as including a plurality of layers of metallic material 18 disposed between two spaced apart layers of fiber material 20. Each layer 20 of fiber material typically has a fineness of 1200 to 1500 denier. Each layer of metallic material 18 is formed from 15-333 Ti alloy foil, which typically has a thickness ranging from 0.04 to 0.06 inch. Each fiber layer 20 may be formed of any one of a plurality of aramid fibers, polyethylene fibers or a combination of the same. For example, fiber layers 20 may be formed from KEVLAR® which is available from DuPont. Alternatively, fiber layers 20 may be formed from SPECTRA SHIELD®, available from Allied Signal Technologies; TWARON®, available from Akzo-Nobel Corporation of the U.K.; or P.B.O. liquid crystal polymer fiber. Metallic layers 18 form a strike surface 22 and a base 24, both of which are discussed more fully below with respect to FIG. 4. As shown in FIG. 3, one of the layers of fiber material 20 is adhered to one side of base 24 using any suitable adhesive known in the art. Strike surface 22 is attached to the side of base 24 opposite to adhesive 26.

Figure 4:
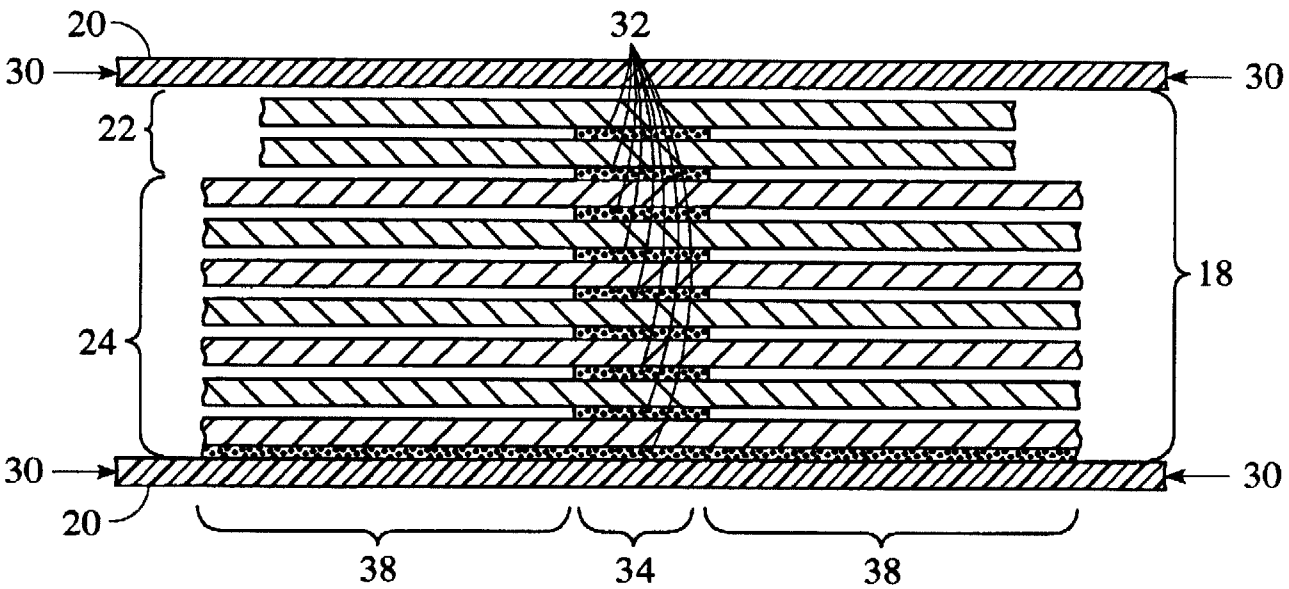
FIG. 4 is a cross-sectional detailed view showing the arrangement of fiber material shown in FIG. 3.

Referring also to FIG. 4, the configuration of metallic 18 and fiber 20 layers is shown. A plurality of metallic layers 18 form base 24 of the armor insert 10. A sufficient number of metallic layers 18 are present to provide base 24 with a thickness ranging from 0.043 to 0.046 inch. Metallic layers 18 that comprise base 24 are coextensive with each other. Two additional metallic layers 18, extending coextensive with each other, are disposed on one side of base 24 forming strike surface 22, with base 24 and strike surface 22 having a common shape. Typically, strike surface 22 includes a sufficient number of metallic layers 18 to provide a thickness ranging from 0.008 to 0.012 inch. The outer edge/boundary of base 24 extends about the outer edge/boundary of strike surface 22, terminating two inches therefrom. In this manner, strike surface 22 is centered on base 24, with all points along the outer edge of base 24 extending equidistant from all points along the outer edge of strike surface 22. A periphery 30 of fiber layers 20 terminates approximately 0.5 inch from the outer edge of base 24.

Metallic layers 18 of base 24 are adhered to each other using any suitable adhesive 32 known in the art. Preferably, a methyl chloride adhesive is employed. Adhesive 32 is applied to a central portion 34 of each metallic layer 18, with central 34 portion comprising approximately 15% of the surface area of each metallic layer 18. In a similar manner, metallic layers 18 that comprise strike surface 22 are adhered to one another and base 24. In this fashion, a central portion 34 of insert 10 is substantially rigid and disposed between two side regions 38 which are substantially flexible.

Figure 5:
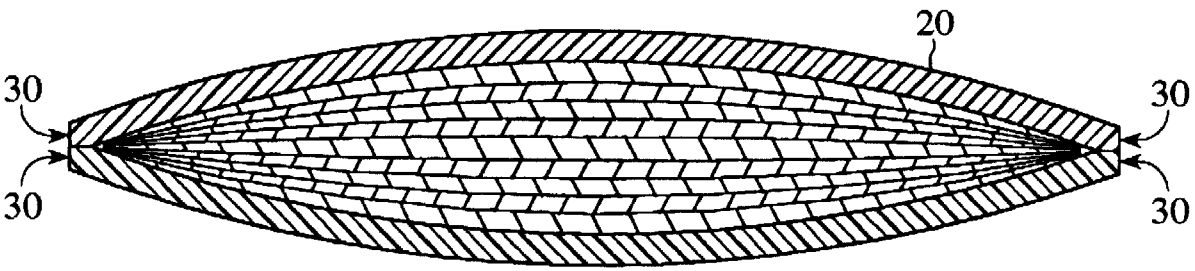
FIG. 5 is a cross-sectional detailed view of the invention shown in FIG. 3, taken across line 5—5.

Referring also to FIG. 5, a cross-section of insert 10 is shown with periphery 30 of each fiber layer 20 bonded together, with all metallic layers disposed therebetween. In this manner, fiber layers 20 encapsulate both strike surface 22 and base 24, thereby providing an insert which is constructed without seams. Abrogating the seams in insert 10 is prompted by the discovery that microscopic spaces in seams compromise the armor's effectiveness in reducing penetration by various weapons. It was found that cutting implements, especially ice picks, easily penetrate a seam by either cutting therethrough or passing between the microscopic spaces. The present invention avoids this problem by attaching various layers of material with adhesives. Additional resistance to penetration by cutting implements is provided by the metallic layers 18, as described below. The bonding of peripheries 30 may be with any suitable adhesive or via thermal bonding. The flexibility of side regions 38 allows insert 10 to conform to the torso of a wearer. The flexibility of side regions 38 is a function of both the absence of adhesive between metallic layers 18 in side regions 38, as well as the inherent flexibility of 15-333 Ti alloy foil. By avoiding the application of adhesive in side regions 38, the portion of each metallic layer 18, which forms side regions 38, is allowed to deform independent of the remaining metallic layers 18. For example, side regions 38 of each metallic layer 18 may have a differing radius of curvature from the remaining layers, and may undergo translational movement with respect to adjacent metallic layers 18. The overall position of the metallic layers 18, however, remains fixed by adhesive 32 in central portion 34.

Essential to proper operation, metallic layers 18 must not only provide the flexibility desired, but must also substantially resist penetration by cutting implements and blunt missiles. To that end, it has been found critical that at least strike surface 22 and approximately 50% of base 24 facing strike surface 22 comprise 15-333 Ti alloy foil, with the remaining 50% of base 24 comprising either 15-333 Ti alloy foil or pure titanium foil. Fiber layers 22 provide the additional protection from blunt missiles, e.g., bullets. The combination of 15-333 Ti alloy foil, the fiber layers and the seamless construction provides a highly flexible, lightweight armor insert which is highly resistive to penetration by many weapon types. Specifically, insert 10 may conform to the torso of a wearer, weighs between 3.5 to 4.5 pounds and resists penetration by knives, ice picks and large caliber bullets.

In tests performed by H.P. White Laboratory, Inc. of Maryland, inserts 10 manufactured in accordance with the aforementioned parameters, with 100% of base 24 comprising 15-333 Ti alloy foil, have proved successful in reducing the penetration by a wide range of weapons. For example, insert 10 was struck with a plurality of ice picks, each of which had a different hardness as measured in units of Rockwell. Each ice pick weighed 0.03 lbs., was 7.0 inches in length and had a diameter of 0.163 inch. Dropped from a height of 33.33 inches with 16.21 lbs. of weight attached, each ice pick struck the insert with 540.3 pounds/square-inch of force while traveling 13.4 ft/sec. The results are as follows:

| Instrument Hardness | Penetration | Average Deformation |
|---|---|---|
| 34 | None | 10 mm |
| 48 | None | 11 mm |
| 51 | None | 23 mm |
| 55 | None | 15 mm |
| 56 | None | 12 mm |
| 57 | None | 11 mm |
| 58 | None | 8 mm |
| 59 | None | 3 mm |

Tests were also conducted by the same laboratory on inserts 10 with base 24 comprising 100% 15-333 Ti foil, using a plurality of boning knives of different hardness, as measured in units of Rockwell. Each boning knife weighed 0.21 lbs. and had a blade 6.0 inches in length. Dropped from a height of 33.33 inches with 16.2 lbs. of weight attached, each boning knife struck the insert with 540 pounds/square-inch of force while traveling 13.4 ft/sec. The results are as follows:

| Instrument Hardness | Penetration | Average Deformation |
|---|---|---|
| 46 | None | 3 mm |
| 49 | None | 3 mm |
| 50 | None | 3 mm |
| 56.5 | None | 4 mm |
| 57 | None | 4 mm |
| 58 | None | 6 mm |

To determine the protection provided by the insert with respect to blunt missiles, H.P. White Laboratories, Inc. conducted a series of tests, on an indoor range. Two inserts 10, with base 24 comprising 100% Ti alloy foil, were subject to shots fired from a .44 Magnum, and two inserts 10, of the same structure, were subjected to shots fired from a 9 mm. The tests were conducted in accordance with MIL-STD-662E, dated 22 Jan. 1987, using caliber .44 Magnum, 240.0 grain lead SWCGC, fired through a 6 inch barrel; and 9 mm, 124.0 grain, FMJ ammunition, fired through a 10 inch barrel. Each insert 10 was mounted 12.5 feet from the muzzle of the test barrel to produce zero degree obliquity impacts. To compute missile velocity, lumiline screens and chronographs were used, with the screens positioned at 5.0 and 10.0 feet. The results are as follows:

| Insert No. | V50 ft/sec | Fastest Velocity with Partial Penetration ft/sec | Slowest Velocity with Complete Penetration ft/sec |
|---|---|---|---|
| | | .44 Magnum | |
| 1 | 1709 | 1713 | 1716 |
| 2 | 1787 | 1808 | 1724 |
| | | 9 mm | |
| 3 | 1772 | 1780 | 1782 |
| 4 | 1818 | 1822 | 1794 |

where V50 is the velocity at which 50% of the shots fired will completely penetrate the armor, and 50% will not completely penetrate the armor. As can be seen from the results, the average V50 for the .44 Magnum is 1748 ft/sec, with the V50 average for the 9 mm being 1795 ft/sec.

Tests were also performed on inserts 10 formed from both 15-333 Ti alloy foil and pure Ti foil layers, to determine the effectiveness of inserts 10 resisting penetration by cutting implements. In these tests, insert 10 was struck with a plurality of ice picks, each of which had a hardness as measured in units of Rockwell. Each ice pick was dropped from a height of 33.33 inches, with 16.21 pounds of weight attached, striking insert 10 with 540 pounds/square inch of force. The results are as follows:

| Instrument Hardness | Penetration | Average Deformation |
|---|---|---|
| 42 | None | 8 mm |
| 42 | None | 10 mm |
| 42 | None | 9 mm |

The resistance to penetration shown above may be increased by increasing either the number of metallic layers 18, fiber layers 20 or both. However, it is desired to minimize the number of layers of each while ensuring desired safety. To that end, including 15-333 Ti alloy foil, as described above, is critical. The 15-333 Ti alloy foil affords maximum protection while minimizing weight and stiffness of the insert 10.

We claim:

1. Composite armor material comprising:

a plurality of foil layers of puncture resistant metallic material, with a central portion of each layer rigidly attached to a central portion of an adjacent foil layer of metallic material with an adhesive, forming a rigid portion disposed between two flexible side regions capable of conforming to a shape of a human torso, with each layer of metallic material of each of said two side regions adapted to undergo translational movement with respect to, and independent of, adjacent layers of metallic material; and a pair of fiber layers each having a periphery attached to each other, with said plurality of foil layers disposed between said pair of fiber layers to form a seamless assembly of armor material.

2. The armor material as recited in claim 1 wherein said plurality of foil layers define a base and a strike surface, each of which includes a boundary, with the boundary of said base extending from the boundary of said strike surface.

3. The armor material as recited in claim 1 wherein said plurality of foil layers define a base and a strike surface, each of which includes a boundary, with the boundary of said base extending about the boundary of said strike surface, terminating two inches therefrom, said base having a thickness ranging from 0.043 to 0.046 inches and said strike surface having a thickness ranging from 0.008 to 0.012 inches.

4. The armor material as recited in claim 1 wherein each of said plurality of foil layers comprises titanium alloy.

5. The armor material as recited in claim 1 wherein each of said plurality of foil layers comprises of 15-333 Ti alloy foil.

6. The armor material as recited in claim 1 wherein said central portion comprises approximately 15% of the total surface area of each of said metallic layers.

7. The armor material as recited in claim 1 wherein each said pair of fiber layers comprises of aramid fibers.

8. The armor material as recited in claim 1 wherein each said pair of fiber layers comprises of polyethylene fibers.

9. Composite armor material comprising:

a plurality of foil layers of puncture resistant metallic material, with a central portion of each foil layer connected to a central portion of an adjacent foil layer of metallic material forming a rigid portion disposed between two flexible unconnected side regions, with each foil layer of metallic material of said flexible side region capable of forming a radius of curvature different from a radius of curvature formed by any one of the remaining foil layers of said flexible side regions, thereby allowing said flexible side regions to conform to a shape of a human torso; and a pair of fiber layers each having a periphery attached to each other and being puncture resistant with respect to blunt missiles, with said plurality of foil layers disposed between said pair of fiber layers to form a seamless assembly of armor material.

10. The armor material as recited in claim 9 wherein said plurality of foil layers define a base and a strike surface, each of which includes a boundary, with all points along the boundary of said base extending equidistant from all points along the boundary of said strike surface.

11. The armor material as recited in claim 10 wherein said boundary of said base extends two inches from said boundary of said strike surface, with said base having a thickness ranging from 0.043 to 0.046 inches and said strike surface having a thickness ranging from 0.008 to 0.012 inches.

12. The armor material as recited in claim 11 wherein each of said plurality of foil layers comprises of titanium alloy.

13. The armor material as recited in claim 12 wherein each of said plurality of foil layers comprises of 15-333 Ti alloy foil.

14. The armor material as recited in claim 13 wherein said central portion comprises approximately 15% of the total surface area of each of said foil layers.

15. The armor material as recited in claim 14 wherein each said pair of fiber layers comprises of aramid fibers.

16. The armor material as recited in claim 14 wherein each said pair of fiber layers comprises of polyethylene fibers.

17. Composite armor material comprising:

a plurality of layers of metallic material, each of which is formed from 15-33 Ti alloy foil, with a central portion of each layer rigidly attached to a central portion of an adjacent layer of metallic material with adhesive, forming a rigid portion disposed between two flexible side regions, with each layer of metallic material of said flexible side regions capable of forming a radius of curvature different from a radius of curvature formed by any one of the remaining metallic layers of said flexible side regions, thereby allowing said flexible side regions to conform to a shape of a human torso; and a pair of fiber layers each having a periphery attached to each other, with said plurality of metallic layers disposed between said pair of fiber layers to form a seamless assembly of armor material.

18. The armor material as recited in claim 17 wherein said plurality of metallic layers define a base and a strike surface having a common shape, each of said base and said strike surface including a boundary, with the boundary of said base extending about the boundary of said strike surface, terminating two inches therefrom so that said strike surface is centered on said base, said base having a thickness ranging from 0.043 to 0.046 inches and said strike surface having a thickness ranging from 0.008 to 0.012 inches.

19. The armor material as recited in claim 18 wherein said fiber layer comprises aramid fibers.

20. The armor material as recited in claim 18 wherein each of said fiber layer comprises polyethylene fibers.

21. The armor material as recited in claim 18 wherein each of said fiber layers comprises fibers.

22. The armor material as recited in claim 18 wherein each of said fiber layers comprises of P.B.O. liquid crystal polymer fibers.

* * * * *